US010575575B2

(12) United States Patent
Freeman Crowe

(10) Patent No.: US 10,575,575 B2
(45) Date of Patent: Mar. 3, 2020

(54) BRA STRAP

(71) Applicant: Delta Textiles (London) Ltd, London (GB)

(72) Inventor: Victoria Freeman Crowe, London (GB)

(73) Assignee: Delta Textiles (London) Ltd, London (GB)

( * ) Notice: Subject to any disclaimer, the term of this patent is extended or adjusted under 35 U.S.C. 154(b) by 82 days.

(21) Appl. No.: 15/910,436

(22) Filed: Mar. 2, 2018

(65) Prior Publication Data

US 2018/0325197 A1 Nov. 15, 2018

Related U.S. Application Data

(60) Provisional application No. 62/504,296, filed on May 10, 2017.

(51) Int. Cl.

| | |
|---|---|
| ***A41C 3/00*** | (2006.01) |
| ***A41F 15/00*** | (2006.01) |
| *A41D 27/24* | (2006.01) |

(52) U.S. Cl.

CPC ..... *A41F 15/002* (2013.01); *A41C 3/0028* (2013.01); *A41D 27/24* (2013.01); *A41F 15/007* (2013.01)

(58) Field of Classification Search

CPC ..... A41C 3/0021; A41C 3/0028; A41C 3/12; A41F 15/007; A41D 2300/326

USPC ..... 450/86

See application file for complete search history.

(56) References Cited

U.S. PATENT DOCUMENTS

| | | | | | |
|---|---|---|---|---|---|
| 2,281,363 | A * | 4/1942 | Lyford | A41F 15/00 | 2/323 |
| 2,615,172 | A * | 10/1952 | Donegan | A41F 15/00 | 2/323 |
| 2,657,392 | A * | 11/1953 | Jackson | A41F 15/00 | 2/323 |
| 4,795,400 | A * | 1/1989 | Greenberg | A41F 15/007 | 2/268 |
| 5,507,682 | A * | 4/1996 | Grahammer | A41F 15/005 | 139/421 |
| 6,083,079 | A | 7/2000 | Pearson | | |
| 6,179,687 | B1 * | 1/2001 | Lee | A41F 1/006 | 2/67 |
| 2004/0053557 | A1 | 3/2004 | Moyer | | |

(Continued)

FOREIGN PATENT DOCUMENTS

| | | |
|---|---|---|
| DE | 9006071 U1 | 9/1991 |
| DE | 20021656 U1 | 3/2001 |

OTHER PUBLICATIONS

Extended European Search Report dated Oct. 15, 2018 in connection with European Patent Application No. 18163885.9.

*Primary Examiner* — Timothy K Trieu

(74) *Attorney, Agent, or Firm* — Pryor Cashman LLP

(57) ABSTRACT

A shoulder strap for a women's bra, as well as the associated women's bra, where the shoulder strap includes a first section having a width, a second section having a width, and a ring, where the first section and the second section are attached to the ring, where the width of the first section proximal to the ring is approximately the same as the width of the second section, and where the width of the first section increases to a width larger than the width of the second section distal from the ring.

12 Claims, 3 Drawing Sheets

(56) References Cited

U.S. PATENT DOCUMENTS

2005/0255791 A1* 11/2005 Fildan ..... A41C 3/12
450/88
2006/0282934 A1* 12/2006 Fildan ..... A41F 15/002
2/86
2010/0093258 A1* 4/2010 Glenn ..... A41F 15/00
450/86

* cited by examiner

BRA STRAP

CROSS-REFERENCE TO RELATED APPLICATIONS

The present application claims priority to U.S. provisional application Ser. No. 62/504,296, filed May 10, 2017, the disclosure of which is incorporated herein by reference in its entirety.

TECHNICAL FIELD

The invention relates to a padded shoulder strap for a woman's bra.

BACKGROUND OF THE INVENTION

Women's bras commonly include shoulder straps, which displace a portion of the weight supported by the bra from a wearer's back to the wearer's shoulders. Women often find these straps to be uncomfortable, as the straps exert pressure on their shoulders and can dig into the skin. There is a need for a bra that adequately addresses this issue.

The bra strap of the present invention is designed to provide increased comfort to the wearer by better managing the weight displaced to the shoulders and softening the straps to be more comfortable to the skin.

SUMMARY OF THE INVENTION

In general, in one aspect, the invention features a shoulder strap for a women's bra, including a first section having a width, a second section having a width, and a ring, where the first section and the second section are attached to the ring, where the width of the first section proximal to the ring is approximately the same as the width of the second section, and where the width of the first section increases to a width larger than the width of the second section distal from the ring.

Implementations of the invention may include one or more of the following features. A portion of the first section may be of an approximately uniform width that is larger than the width of the second section. The width of the second section may be an approximately uniform width. The second section may include means for adjusting the length of the second section, which may be a slider. The first section may have an inner portion, and the inner portion may include fiber fill foam. The first section may have a first side, the first side may have an outer portion, and the outer portion may include cooling yarns. The first section may have a second side, the second side may have an outer portion, and the outer portion may include a textured, cushioning fabric padding. The first section may have a second side, the second side may have an outer portion, and the outer portion may have a soft, gripping finish. The edges of an outer portion of a first side of the first section and an outer portion of a second side of the first section may be ultrasonically sealed.

In general, in another aspect, the invention features a women's bra including at least a shoulder strap, where the shoulder strap includes a first section having a width, a second section having a width, and a ring, where the first section and the second section are attached to the ring, where the width of the first section proximal to the ring is approximately the same as the width of the second section, and where the width of the first section increases to a width larger than the width of the second section distal from the ring.

Implementations of the invention may include one or more of the following features. A portion of the first section may be of an approximately uniform width that is larger than the width of the second section. The width of the second section may be an approximately uniform width. The second section may include means for adjusting the length of the second section, which may be a slider. The first section may have an inner portion, and the inner portion may include fiber fill foam. The first section may have a first side, the first side may have an outer portion, and the outer portion may include cooling yarns. The first section may have a second side, the second side may have an outer portion, and the outer portion may include a textured, cushioning fabric padding. The first section may have a second side, the second side may have an outer portion, and the outer portion may have a soft, gripping finish. The edges of an outer portion of a first side of the first section and an outer portion of a second side of the first section may be ultrasonically sealed.

DETAILED DESCRIPTION OF THE INVENTION

Figure 1:
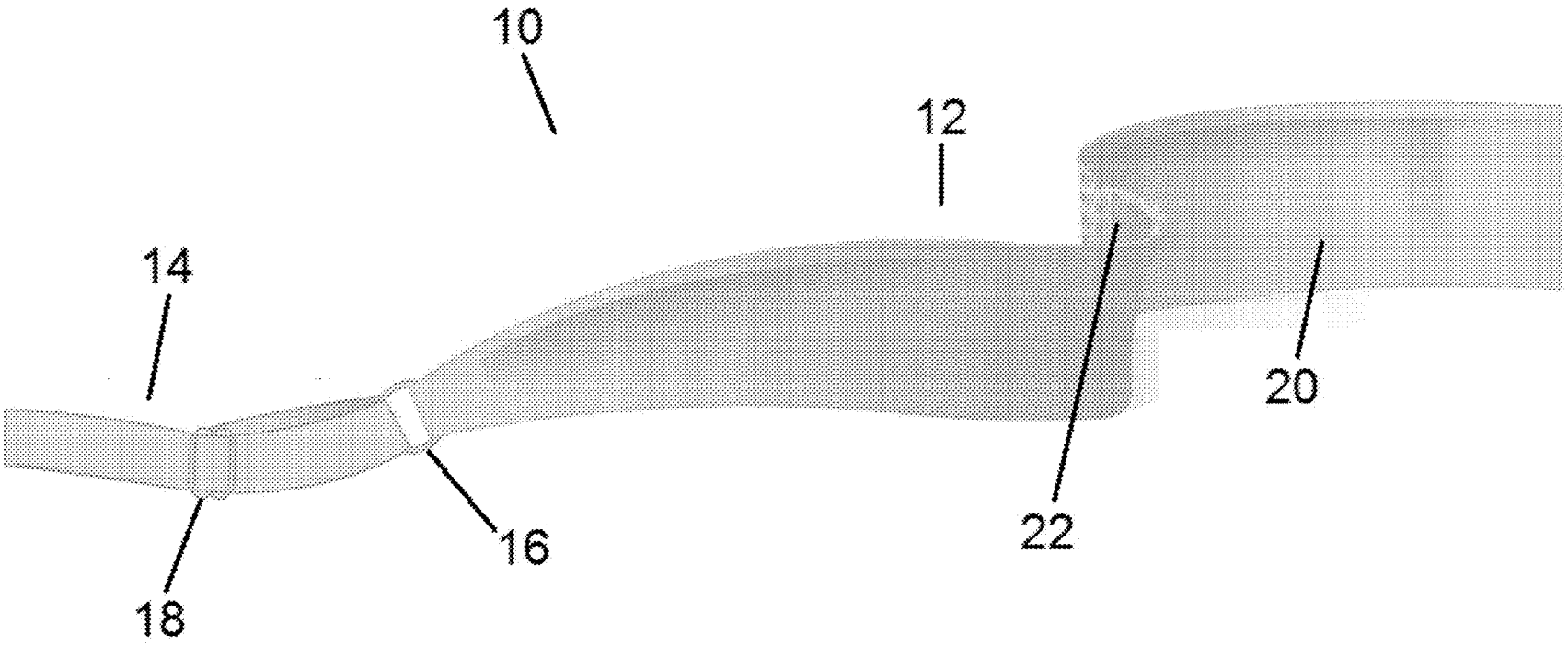
FIG. 1 is a view of the top side of a strap according to one embodiment of the present invention.
Figure 2:
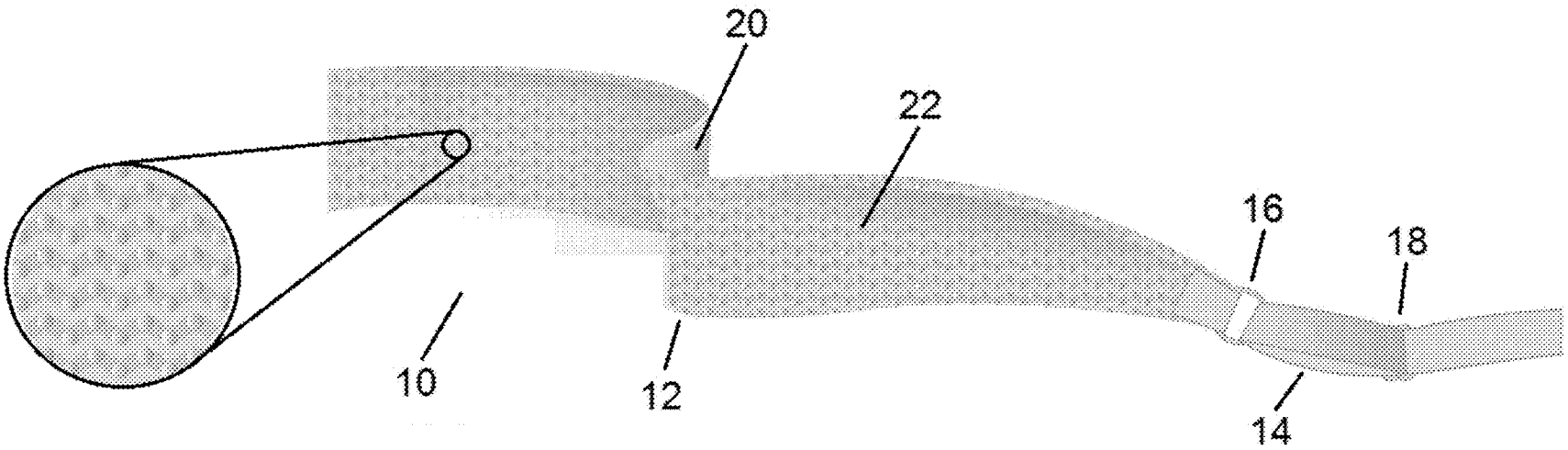
FIG. 2 is a back view of the underside of the strap of FIG. 1.
Figure 3:
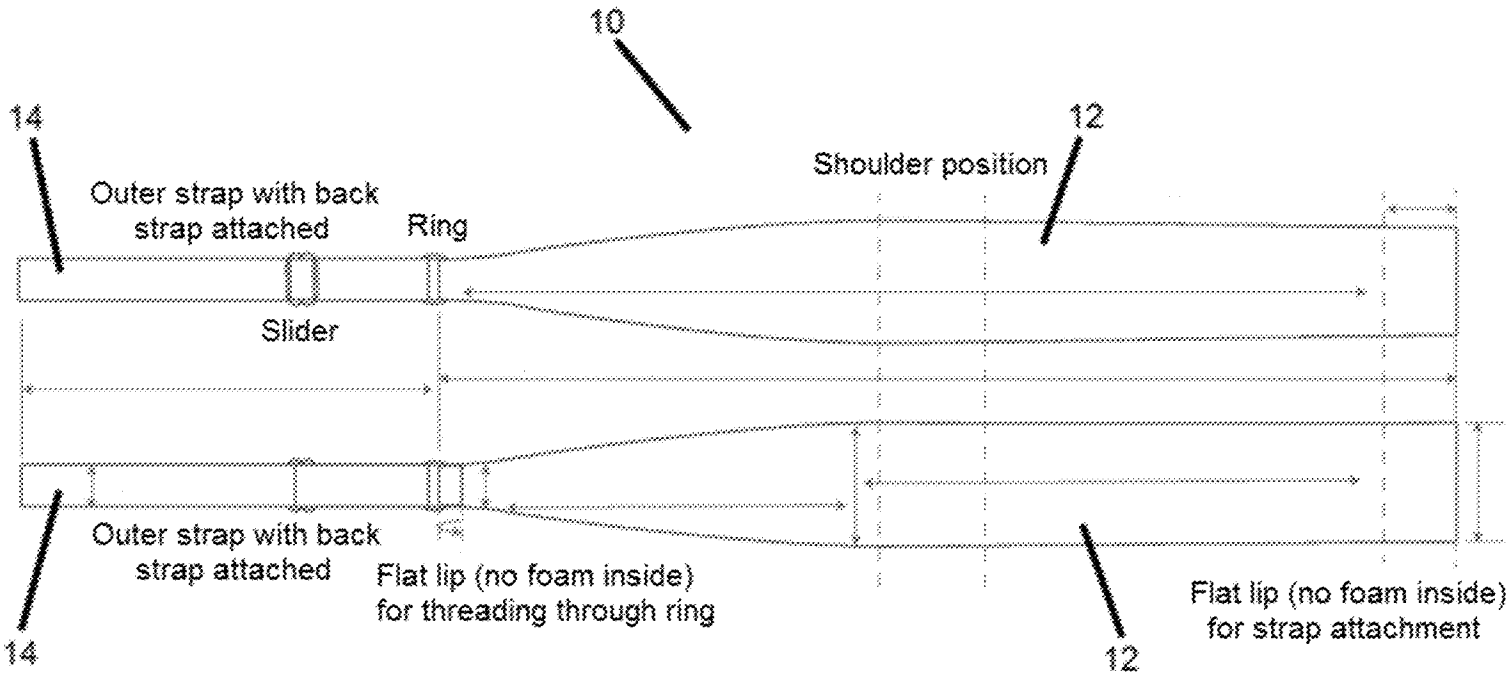
FIG. 3 is a diagram of a strap according to one embodiment of the present invention.

FIGS. 1 and 2 illustrate a strap of an embodiment of the present invention, specifically shoulder strap 10 for use in apparel, such as women's bras. FIG. 3 illustrates a diagram of shoulder strap 10 according to one embodiment of the present invention. The strap generally has two sections, namely a thicker shoulder section 12 and a thinner back section 14.

The shoulder section 12 is of an appropriate length to span the top of the shoulder of a wearer and to connect a front portion of the bra to a back portion of the bra or to the other parts of the bra or the garment. In one embodiment, the length of the shoulder section is 20 cm, with additional 3 cm for stitching. One end of the shoulder section is attached via a ring 16 to the back section. This end may be attached to the ring 16 by placing the end through the ring and ultrasonically bonding the end back onto itself around the ring. At this end, the shoulder section 12 is thinner, preferably 2 cm in width, or the thickness of the back section. The shoulder section gradually widens, preferably over a length of 5 cm, from the portion proximal to the ring to the portion distal from the ring, preferably to 3 cm in width, so that the part of the shoulder section that lies on the wearer's shoulder, preferably 15 cm in length, rather than the part that connects portions of the garment, is wider, thereby displacing weight supported by the strap over a wider surface area and relieving pressure at any one point on the shoulder.

The shoulder section 12 preferably is lightweight and made of a breathable and quick dry fiber fill foam on the inside, with cooling yarns on the outer fabric that are also breathable and cooling on the skin. An end of shoulder section 12, such as an end for threading through ring 16 or an end for strap attachment, may be a flat lip with no foam disposed inside this portion. The flat lip at the end threading through ring 16 may extend 1.5 cm in length. The underside of the shoulder strap 22, i.e., the side of the shoulder that touches the wearer's skin, is preferably padded with a cushioning and textured fabric that provides a massaging effect to the skin. The underside 22 preferably also has a gripping and soft finish. Both the underside and the top side 20 of the shoulder strap have extremely soft finished edges that are ultrasonically sealed. A label or logo may be ultrasonically embossed onto the shoulder strap or on other locations.

The back section 14 may be of a variety of forms and is preferably a standard bra strap that spans from the back of the bra or garment to the ring 16, thus connecting the shoulder section 12 to the back of the garment. The back section is looped through the ring 16. The end of the back section is connected to a slider 18 on the strap, enabling a user to adjust the length of back section and thereby the length of the strap overall. The back section is preferably 2 cm wide and is formed of a thin, sturdy, and stretchable material, although other materials may be used.

In one embodiment of the present invention, the outer fabric of shoulder section 12 includes a 32 gauge single jersey material composed of 84% nylon constituting cooling yarns with moisture management and 16% elastane 140 g. In another embodiment of the present invention, the inside fiber fill foam of shoulder section 12 is 100% polyester having a weight of 0.098 kg/m and an ASKER-F hardness of 22. In another embodiment of the present invention, the cushioning and textured fabric on the underside of shoulder strap 22 includes a double jersey material composed of 82% nylon constituting cooling yarns with moisture management and 18% elastane 190 g. In another embodiment of the present invention, a stabilizer is disposed in shoulder strap 22, and the stabilizer may be 100% nylon 40 g.

It will be understood by those of ordinary skill in the art that various changes may be made and equivalents may be substituted for elements without departing from the scope of the invention. In addition, many modifications may be made to adapt a particular feature or material to the teachings of the invention without departing from the scope thereof. Therefore, it is intended that the invention not be limited to the particular embodiments disclosed, but that the invention will include all embodiments falling within the scope of the claims.

What is claimed is:

1. A shoulder strap for a women's bra, comprising: a first section having a width, an inner portion comprising fiber fill foam, and a first side including an outer portion comprising cooling yarn;

a second section having a width and slider for adjusting the length of the second section; and a ring;

wherein the first section and the second section are attached directly to the ring;

wherein the width of the first section proximal to the ring is approximately the same as the width of the second section; and wherein the width of the first section increases to a width larger than the width of the second section distal from the ring.

2. The shoulder strap of claim 1, wherein a portion of the first section is of an approximately uniform width that is larger than the width of the second section.

3. The shoulder strap of claim 1, wherein the width of the second section is an approximately uniform width.

4. The shoulder strap of claim 1, wherein the first section has a second side, wherein the second side has an outer portion, and wherein the outer portion comprises a textured, cushioning fabric padding.

5. The shoulder strap of claim 1, wherein the first section has a second side, wherein the second side has an outer portion, and wherein the outer portion has a soft, gripping finish.

6. The shoulder strap of claim 1, wherein edges of an outer portion of a first side of the first section and an outer portion of a second side of the first section are ultrasonically sealed.

7. A women's bra comprising: at least a shoulder strap;

wherein the shoulder strap comprises:

a first section having a width, an inner portion comprising fiber fill foam, and a first side including an outer portion comprising cooling yarn;

a second section having a width and slider for adjusting the length of the second section; and a ring;

wherein the first section and the second section are attached directly to the ring;

wherein the width of the first section proximal to the ring is approximately the same as the width of the second section; and wherein the width of the first section increases to a width larger than the width of the second section distal from the ring.

8. The women's bra of claim 7, wherein a portion of the first section is of an approximately uniform width that is larger than the width of the second section.

9. The women's bra of claim 7, wherein the width of the second section is an approximately uniform width.

10. The women's bra of claim 7, wherein the first section has a second side, wherein the second side has an outer portion, and wherein the outer portion comprises a textured, cushioning fabric padding.

11. The women's bra of claim 7, wherein the first section has a second side, wherein the second side has an outer portion, and wherein the outer portion has a soft, gripping finish.

12. The women's bra of claim 7, wherein edges of an outer portion of a first side of the first section and an outer portion of a second side of the first section are ultrasonically sealed.

* * * * *